US006254309B1

(12) United States Patent
Northcott et al.

(10) Patent No.: US 6,254,309 B1
(45) Date of Patent: Jul. 3, 2001

(54) SUBMERSIBLE STORAGE VESSEL SYSTEM

(75) Inventors: Robert William Northcott, 2032 Crocus Road N.W., Calgary, Alberta (CA), T2L 0Z8; Grant M. Askin, Jarvis Bay (CA)

(73) Assignee: Robert William Northcott, Alberta (CA)

( * ) Notice: Subject to any disclaimer, the term of this patent is extended or adjusted under 35 U.S.C. 154(b) by 0 days.

(21) Appl. No.: 09/204,183

(22) Filed: Dec. 3, 1998

(30) Foreign Application Priority Data

Dec. 1, 1998 (CA) ..... 2254713

(51) Int. Cl.[7] ..... B65D 88/76
(52) U.S. Cl. ..... 405/53; 220/23.91
(58) Field of Search ..... 405/210, 52, 53; 220/23.91

(56) References Cited

U.S. PATENT DOCUMENTS

| | | | | |
|---|---|---|---|---|
| 2,748,739 | * | 6/1956 | Monti et al. | 405/210 X |
| 2,990,796 | * | 7/1961 | Cole et al. | 405/210 X |
| 3,665,721 | * | 5/1972 | Wyllie | 405/210 |
| 4,190,072 | * | 2/1980 | Fernandez et al. | 405/210 X |
| 4,632,603 | * | 12/1986 | Baugh | 405/210 |
| 4,934,866 | | 6/1990 | Gage . | |
| 4,961,293 | | 10/1990 | House et al. . | |
| 5,037,239 | | 8/1991 | Olsen et al. . | |
| 5,271,493 | | 12/1993 | Hall . | |
| 5,391,019 | | 2/1995 | Morgan . | |
| 5,495,695 | | 3/1996 | Eliott, Jr. . | |
| 5,555,999 | | 9/1996 | Wilcox . | |
| 5,564,588 | | 10/1996 | Reese . | |
| 5,601,204 | | 2/1997 | Hall . | |
| 5,664,696 | | 9/1997 | Canga . | |

FOREIGN PATENT DOCUMENTS

| | | | | |
|---|---|---|---|---|
| 0436238 | * | 9/1949 | (IT) | 405/210 |
| 0623712 | * | 8/1961 | (IT) | 405/210 |

OTHER PUBLICATIONS

Brochure entitled "Protecting Your Business, Preserving The Environment—GREENTANK™—Double–Wall Oilfield Service Tank Systems," ZCL Fiberglass, a Division of ZCL Composites Inc., undated, 3 pages.

Brochure entitled "Quick Guide Fot Installation of Oilfield Service Tanks For Single Wall and Double Wall Fiberglass Underground Storage Tanks—GREENTANK®", ZCL Fiberglass, a Division of ZCL Composites Inc., Nov. 1995, 4 pages.

Brochure entitled "Double Wall/Double Composite Tanks," Tankman, a Division of ETT Chemicals Inc., undated, 4 pages.

Brochure entitled "Double Wall/Double Composite Tank Installation Procedure," Tankman, a Division of ETT Chemicals Inc., undated, 3 pages.

* cited by examiner

*Primary Examiner*—David Bagnell
*Assistant Examiner*—Frederick L. Lagman
(74) *Attorney, Agent, or Firm*—Rodman & Rodman

(57) ABSTRACT

The invention is directed at a submersible storage vessel system and components thereof. The system includes a storage vessel and a support structure for supporting the storage vessel such that a downward gravitational force applied to the storage vessel and an upward buoyancy force applied to the storage vessel are both transferred to the support structure. More particularly, the support structure includes a bearing surface for contacting a ground surface so that the system is supported on the ground surface, a vessel support for supporting the storage vessel so that the downward gravitational force applied to the storage vessel is transferred to the support structure and a vessel anchor for anchoring the storage vessel so that the upward buoyancy force applied to the storage vessel is transferred to the support structure.

26 Claims, 8 Drawing Sheets

SUBMERSIBLE STORAGE VESSEL SYSTEM

FIELD OF INVENTION

The present invention relates to a submersible storage vessel system and components thereof. More particularly, the system comprises a storage vessel and a support structure for the storage vessel, which support structure permits both downward gravitational forces and upward buoyancy forces applied to the storage vessel to be transferred to the support structure.

BACKGROUND OF INVENTION

Underground storage vessels are commonly used for the storage of a variety of fluids including water, chemicals and hydrocarbons. In the past, such vessels have been typically comprised of steel. However, steel vessels are relatively heavy, leading to difficulties with the transportation and installation of such vessels and the resulting costs associated with such difficulties. Further, steel vessels are subject to corrosion when left in place for a substantial period of time. As a result of the tendency to corrode over the years, regular repair and replacement of these vessels is often required in order to avoid vessel failure and the resulting potential for ground contamination when the vessel contains environmentally hazardous fluids.

As a result of the difficulties associated with underground storage vessels made of steel, many underground storage vessels in use today are comprised of fiberglass. These fiberglass storage vessels may be single walled or double walled where secondary containment is desired for hazardous fluids contained within the vessel. For instance, the majority of underground fiberglass vessels are double walled with a monitor in the interstitial space between the inner and outer walls in order to ensure the integrity of the walls. It has been found that fiberglass is relatively light in weight as compared to steel and that it is corrosion free both internally and externally. Accordingly, fiberglass tends to be well suited for underground installation.

However, fiberglass vessels often present their own difficulties with respect to their use and installation. For instance, fiberglass vessels are relatively delicate in that the material tends to be easily damaged. Where the fiberglass material is damaged, there is a risk of vessel failure, with the resulting environmental hazards and remediation costs, including the cost of replacement or repair of the vessel. More particularly, fiberglass vessels are commonly subjected to material damage during handling and loading of the vessel both prior to and during installation at a new site. Similarly, damage may be caused during the relocation or removal of a vessel from an existing site.

Further, the vessel wall may fail as a result of stresses or forces imposed on the installed vessel due to ground movement or settling of the vessel or due to the effects of buoyancy on the vessel from any ground water at the site. Ground movement or settling, the effects of buoyancy and improper installation may also lead to a failure of the nozzles or fittings associated with the vessel at the point or location of connection of the fittings to the vessel. Finally, current methods for the installation of underground storage vessels, and in particular fiberglass vessels, as discussed further below, tend to be both relatively costly, time consuming and potentially hazardous.

One method of installing underground storage vessels, including fiberglass storage vessels, requires extensive site preparation including the installation of an anchoring system. Specifically, the intended site of the storage vessel is excavated to the necessary dimensions to permit the installation of the vessel and to permit one or more people to work within the excavation. An anchoring system is then installed at the base of the excavation. A typical anchoring system includes concrete holddowns or pile holddowns installed at the base of the site and one or more straps which pass about the vessel and are connected to the holddowns. The vessel is lowered into the site and the anchoring system is manually connected to the vessel. The excavated site is then backfilled to the ground surface. Further, once the installation is completed, the storage vessel is typically tested to ensure the integrity of the underground system.

As the vessel is installed directly into the excavated site, the site must be carefully prepared and compacted, where necessary, prior to the installation of the storage vessel. In addition, the anchoring system must be installed within the site prior to the installation of the vessel. Further, if excessive water accumulation is anticipated at the excavated site or the site has a particularly high water table, the water level must be kept as low as possible during installation in order to properly install the vessel. As a result, the use of pumps and ballast tanks may be required for the installation. Finally, the installation of the anchoring system is critical to the reliability or integrity of the vessel. Specifically, small shifts in the position of the anchoring system may lead to shifts in the position of the storage vessel, which may lead to a rupture or failure of the fittings or piping between the vessel and the surface. Typically, such failures occur at the point or location of the connection of the fitting to the vessel.

Once the site is prepared, the vessel is shipped to the site and installed in a relatively unprotected state. As a result, significant damage may occur to the material of the vessel during the shipping and installation procedures. Similarly, in the event that repair of the storage vessel is required, excavation of the unprotected vessel may also result in significant damage to the vessel.

As well, the installation of the anchoring system, the installation of the vessel and the connection of the anchoring system to the vessel are typically labor intensive tasks and typically require one or more people to work within the excavated site. The need for the presence of one or more people within the excavated site presents various excavation requirements in order to provide access to the site and to minimize any resulting safety hazards. For instance, strict safety standards for the excavation must typically be followed, including requirements for a relatively large excavation site and for sloping of the excavated walls. These requirements may increase the cost of the preparation of the site prior to the actual installation of the vessel.

Further, the backfill for the excavated site must be carefully selected given the direct physical contact of the backfill with the storage vessel. This is particularly important when the storage vessel is made of fiberglass. The need for a particular type of backfill may further increase the cost of the installation. As well, the backfill operation must be carefully conducted in order to avoid damage to the vessel and proper compaction about the vessel.

A further method of installing underground storage vessels is to provide an underground vault in which the storage vessel is installed. As the vessel is placed within the underground vault, some protection is provided to the vessel following the installation. As well, where environmentally hazardous fluids are contained within the vessel, the vault may provide secondary containment in the event of any leakage. However, this method of installation is also not completely satisfactory.

For instance, the site must still be prepared in advance of the installation of the vessel by either preparing or constructing the vault on-site or assembling pre-fabricated elements of the vault at the site. Alternately, the fully assembled vessel and vault structure may be transported to the site for installation, however, the size and weight of the fully assembled unit may present problems with respect to its transportation to and installation at the site. In addition, in some cases, the vault itself may require the installation of an anchoring system at the site or the attachment of deadweights to ensure the anchoring of the vault structure. Thus, this method of installation and subsequent testing of underground storage vessels continues to be time consuming, labor intensive and presents its own disadvantages and safety hazards which must be addressed.

Further, unless the vault is transported to the site within a fully assembled vault structure, the vessel must still be shipped to the site for installation in a relatively unprotected state. Thus, significant damage may still occur to the material of the vessel during the shipping and installation procedures. Similarly, although the vault provides some measure of protection to the vessel, repair or replacement of the unprotected vessel may result in damage to the vessel, particularly where the vault contains backfill material about the vessel.

One example of a vault which is prepared on-site is provided by U.S. Pat. No. 4,934,866 issued Jun. 19, 1990 to Gage. Gage describes an underground fiberglass vault into which one or more underground storage vessels are secured. To install the vault, a pit is excavated and a concrete base is poured in the bottom of the pit. The sides of the pit are lined with sheetrock panels and a liquefied fiberglass mixture is sprayed onto the panels and the concrete slab. One or more underground storage vessels are then placed within the vault, secured to the floor by conventional anchors and cables and connected to conventional supply lines. The anchors may be placed in the concrete base prior to its hardening or may be placed in a base layer of pea gravel contained within the vault. Once the vessels are anchored, the remainder of the vault is backfilled with further pea gravel.

One example of a vault which is pre-fabricated and assembled on-site is provided by U.S. Pat. No. 4,961,293 issued Oct. 9, 1990 to House et. al. This patent describes a precast, prestressed concrete secondary containment vault comprised of a number of units including a bottom unit, a top unit and a collar or side unit. Each unit is comprised of one or more concrete panels which interlock to form the various units of the vault. Cradles for supporting the storage vessels are contained within the bottom unit. To install the vault, the construction location is first excavated and a sand bed is graded. The bottom unit is then lowered into the excavation pit and leveled. The cradles are pinned to the inner face of the bottom unit. The collar unit is then lowered onto the bottom unit and the storage vessel is installed therein. Finally, the top unit is lowered into place and the excavation pit is backfilled.

Further, U.S. Pat. No. 5,037,239 issued Aug. 6, 1991 to Olsen et. al. describes a vault structure designed so that all of the panels used in its construction may be precast at a remote site and transported to the construction site for assembly. The construction site is excavated and prepared for the structure. The floor panels are then lowered into the excavation and assembled, followed by positioning of the walls, storage vessels and roof. The storage vessels are supported on the floor by cradles. More particularly, the vault is comprised of three precast concrete floor panels, three precast concrete roof panels and four precast concrete wall panels. The size and number of the panels is limited by the allowable size and weight of panel that can be transported to the construction site.

U.S. Pat. No. 5,664,696 issued Sep. 9, 1997 to Canga describes a two stage construction of an underground vault. The first stage is a lower stage which includes a floor and part of the sides extending up to a level approximately that of the height of the storage vessel. The second stage is an upper stage which rests on the lower stage and which supports the lid of the vault. Once the lower stage is lowered into place in the excavation, a bed of filler material is poured into the lower stage. The storage vessel is placed within the lower stage on the bed of filler material. Once the piping to the surface is connected, further filler material is added and the upper stage is lowered into position. The lid is then placed on the upper stage. The walls of the vault have means for coupling slings for hoisting and lowering the vault. These coupling means may also be used for attaching deadweights after installation, in place of a more conventional anchoring system. The deadweights are required to stabilize the vault underground and to avoid flotation which may endanger the vault structure and the fittings or piping.

Further examples of pre-cast or pre-fabricated vaults are provided by U.S. Pat. No. 5,391,019 issued Feb. 21, 1995 to Morgan and U.S. Pat. No. 5,495,695 issued Mar. 5, 1996 to Elliot. Jr.

Thus, there remains a need in the industry for an improved submersible storage vessel system. Further, there is a need for a submersible storage vessel system which may be transported to and installed at the construction site as an integral unit. As well, there is a need for an integral unit or system which supports the storage vessel with respect to the downward gravitational forces applied to the storage vessel and which supports or anchors the storage vessel against any upward buoyancy forces applied to the storage vessel. Further, the integral unit or system preferably protects the storage vessel during installation and transportation to the site and aids in the installation of the storage vessel. Finally, there is a need for an integral unit or system which provides support to the fittings or piping connected to the storage vessel, particularly at the location of the connection of the fitting to the vessel.

SUMMARY OF INVENTION

The present invention is directed at a submersible storage vessel system and components thereof. More particularly, the present invention is directed at a support structure for a submersible storage vessel and to a submersible storage vessel system for installation as an integral unit. The system or integral unit comprises a storage vessel and a support structure for the storage vessel. Preferably, the integral unit or system of the within invention supports the storage vessel with respect to the downward gravitational forces applied to the storage vessel and further supports or anchors the storage vessel with respect to any upward buoyancy forces applied to the storage vessel. More particularly, any downward gravitational forces applied to the storage vessel and any upward buoyancy forces applied to the storage vessel are both preferably transferred to the support structure.

Further, the integral unit or system also preferably provides protection to the storage vessel during installation and transportation to the construction or excavation site and preferably aids in the installation of the storage vessel. Finally, the integral unit or system preferably provides support to the fittings or piping connected to the storage vessel, particularly at the location of the connection of the fitting to the vessel.

In one aspect of the invention, the invention is comprised of a submersible storage vessel system for installation as an integral unit. The system comprises:

(a) a storage vessel; and (b) a support structure for supporting the storage vessel such that a downward gravitational force applied to the storage vessel and an upward buoyancy force applied to the storage vessel are both transferred to the support structure.

The submersible storage vessel system may be submerged in any enveloping medium. However, in the preferred embodiment, the system provides an underground storage vessel system. Further, the system has a weight sufficient to overcome the upward buoyancy force when the system is submerged and the storage vessel is empty.

The storage vessel may be comprised of any material which is compatible with the medium or material in which the vessel is to be installed or submerged and which is compatible with the fluids or other material to be contained within the vessel. Accordingly, in the preferred embodiment, the storage vessel may be comprised of any material compatible with its placement or installation in the ground. Thus, the vessel material is preferably resistant to corrosion. In the preferred embodiment, the storage vessel is comprised of fiberglass.

Further, the storage vessel is comprised of an exterior surface and defines an interior chamber for storage of fluids therein. Any fluids or other materials, compatible with the material comprising the vessel, may be contained therein. The storage vessel may provide a single-walled structure or a double-walled structure. However, where the fluids or material contained within the vessel are hazardous in nature, a double-walled structure is preferred to provide secondary containment in the event of a failure of the storage vessel. The storage vessel may have any shape or dimensions compatible with the desired installation of the system. Preferably, the storage vessel has a vessel length, a first vessel end and a second vessel end. In the preferred embodiment, the storage vessel is comprised of an elongated, substantially tubular tank.

As well, the storage vessel is preferably comprised of at least one fitting to facilitate communication with the interior chamber of the storage vessel. Each fitting may act as an inlet, an outlet or both to the storage vessel and may permit the passage of the fluids or material contained, or to be contained, within the vessel therethrough.

As stated, the support structure provides support for the storage vessel as described above. Further, the support structure preferably defines a vessel housing, wherein the storage vessel is contained within the vessel housing. In the preferred embodiment, the vessel housing provides at least some protection to the storage vessel contained therein.

As well, the support structure may have any shape or dimensions compatible with the desired installation of the system and compatible with supporting the storage vessel therein in the described manner. Further, the shape and dimensions of the support structure preferably permit the definition of the vessel housing such that the storage vessel may be contained therein. In the preferred embodiment, the support structure has a first support structure end and a second support structure end.

Preferably, the support structure of the system is comprised of:

(a) a bearing surface for contacting a ground surface so that the system is supported on the ground surface;

(b) a vessel support for supporting the storage vessel so that the downward gravitational force applied to the storage vessel is transferred to the support structure; and (c) a vessel anchor for anchoring the storage vessel so that the upward buoyancy force applied to the storage vessel is transferred to the support structure.

The support structure, including the bearing surface, the vessel support and the vessel anchor may be comprised of any elements, components or members connected, welded or otherwise fastened together which are able to support the system and the storage vessel in the manner described above. Further, the support structure may be comprised of any material which is compatible with the medium or material in which the system is to be installed or submerged. Accordingly, in the preferred embodiment, the support structure may be comprised of any material compatible with its placement or installation in the ground.

The bearing surface of the support structure contacts the ground surface for supporting the system. In the preferred embodiment, the ground surface is comprised of the base of an excavated pit in the earth, in which the system is to be installed. However, the ground surface may be comprised of any surface capable of supporting the system thereon. Thus, the bearing surface may contact any such surface capable of supporting the system thereon.

The vessel support preferably contacts the exterior surface of the storage vessel at more than one location on the exterior surface of the storage vessel. Further, the vessel support is preferably comprised of a plurality of vessel support elements which contact the exterior surface of the storage vessel at a plurality of locations on the exterior surface of the storage vessel. In the preferred embodiment, the vessel support elements support the storage vessel between the first vessel end and the second vessel end.

The vessel support elements may be comprised of any components, members or structure able to support the storage vessel, as described, so that the downward gravitational force applied to the storage vessel is transferred to the support structure. Preferably, the vessel support elements are comprised of a plurality of transverse ribs which are spaced between the first vessel end and the second vessel end to support the storage vessel between the first vessel end and the second vessel end. The vessel support elements are further preferably comprised of a first longitudinal rib for supporting the storage vessel at the first vessel end and a second longitudinal rib for supporting the storage vessel at the second vessel end.

The vessel anchor is preferably comprised of at least one holddown device associated with the support structure for connecting the storage vessel with the support structure. The holddown device may be comprised of any components, elements, members or structure able to anchor the storage vessel so that the upward buoyancy force applied to the storage vessel is transferred to the support structure. Preferably, the holddown device is comprised of at least one holddown strap. In the preferred embodiment, the vessel anchor is comprised of a first holddown strap and a second holddown strap which connect the storage vessel to the support structure between the first vessel end and the second vessel end.

The support structure is preferably capable of being lifted without applying a lifting force directly to the storage vessel. Thus, the support structure is preferably comprised of at least one lifting lug for lifting the system without applying a lifting force directly to the storage vessel. In the preferred embodiment, the support structure is comprised of a first lifting lug located adjacent to the first support structure end and a second lifting lug located adjacent to the second support structure end, wherein the first lifting lug and the second lifting lug enable the system to be lifted without applying the lifting force directly to the storage vessel.

The lifting lugs may be associated with any portion, components, elements or members of the support structure. However, preferably, the support structure is comprised of a first frame element located adjacent to the first support structure end and a second frame element located adjacent to the second support structure end. In this instance, the first lifting lug is preferably associated with the first frame element and the second lifting lug is preferably associated with the second frame element.

The support structure is preferably further comprised of a fitting anchor for connecting the fitting with the support structure so that a fitting force applied to the fitting is transferred to the support structure. Any fitting anchor capable of transferring the fitting force from the fitting to the support structure may be used. Further, the fitting anchor may be associated or connected with any portion, components, elements or members of the support structure. For instance, the fitting anchor may connect the fitting to the first frame element or to the second frame element. However, in the preferred embodiment, the support structure is comprised of a third frame element which is connected to at least one of the first frame element and the second frame element. In the preferred embodiment, the fitting anchor connects the fitting to the first frame element, to the second frame element, or to the third frame element.

Finally, the support structure is preferably further comprised of an exterior shell substantially surrounding the vessel housing and the system is further comprised of a packing material. The packing material is contained within the exterior shell such that the storage vessel is substantially surrounded by the packing material. The exterior shell may be comprised of any elements, components, members or structure capable of substantially surrounding the vessel housing and the storage vessel contained therein. Further, the exterior shell may be comprised of any material which is compatible with the medium or material in which the system is to be installed or submerged. Accordingly, in the preferred embodiment, the exterior shell may be comprised of any material compatible with its placement or installation in the ground.

In addition, the packing material may be comprised of any material able to be contained within the exterior shell and which is compatible with the material comprising the storage vessel. Further, the packing material is preferably comprised of a material able to provide support to the exterior surface of the storage vessel without causing significant damage to it. For instance, the packing material may be comprised of aggregate. The packing material may also be comprised of rubber particles. However preferably, the packing material is comprised of both aggregate and rubber particles. Specifically, in the preferred embodiment, the packing material is comprised of rubber particles covered with a layer of aggregate.

BRIEF DESCRIPTION OF DRAWINGS

Embodiments of the invention will now be described with reference to the accompanying drawings, in which.

DETAILED DESCRIPTION

The present invention is directed at a support structure for a submersible storage vessel. The support structure supports the storage vessel such that a downward gravitational force applied to the storage vessel and an upward buoyancy force applied to the storage vessel are both transferred to the support structure.

The downward gravitational force will typically arise due to the weight of the storage vessel and its contents. The upward buoyancy force will typically arise due to the storage vessel being submerged in situations where it is fully or partially empty or is filled with material which has a lower density than the medium in which it is submerged.

The support structure therefore serves to protect the storage vessel from stress and resulting damage which may be caused by the downward gravitational force or the upward buoyancy force acting on the storage vessel. These forces may typically act on the storage vessel during installation of the storage vessel in or removal of the storage vessel from a submerged environment or during the service life of the storage vessel while it is submerged. By transferring the forces to the support structure, the forces may be controlled so as to prevent the storage vessel from experiencing stresses that could damage the storage vessel.

In a preferred embodiment of the invention the invention relates to a submersible storage vessel system comprising the storage vessel and the support structure. The system may be assembled into an integral unit before being submerged, thus potentially reducing installation time and costs in comparison with the installation of submersible storage vessels not including the support structure.

In this specification, "submersible" means the capacity to be put or sink below the surface of ground, water or any other enveloping medium. In the preferred embodiment, the storage vessel system is intended to be submerged below a ground surface in circumstances where there the system may also be submerged or partly submerged by water such as groundwater. In other words, the preferred embodiment is intended for use in circumstances where the groundwater table may either temporarily or permanently extend above the lowest portion of the installed storage vessel, thus creating the upward buoyancy force.

Figure 1:
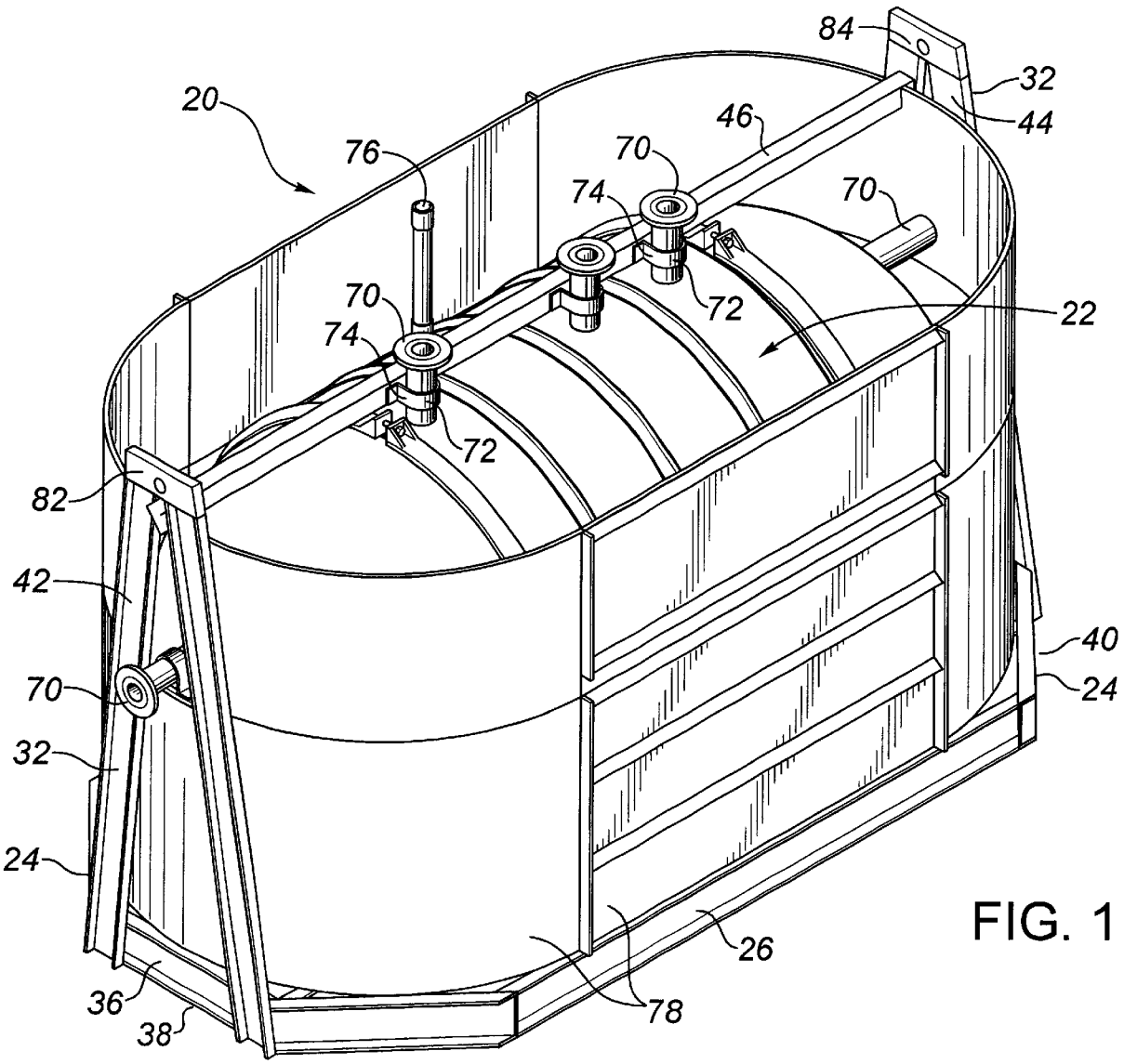
FIG. 1 is a pictorial view of a preferred embodiment of a submersible storage vessel system comprising a support structure and a storage vessel.
Figure 2:
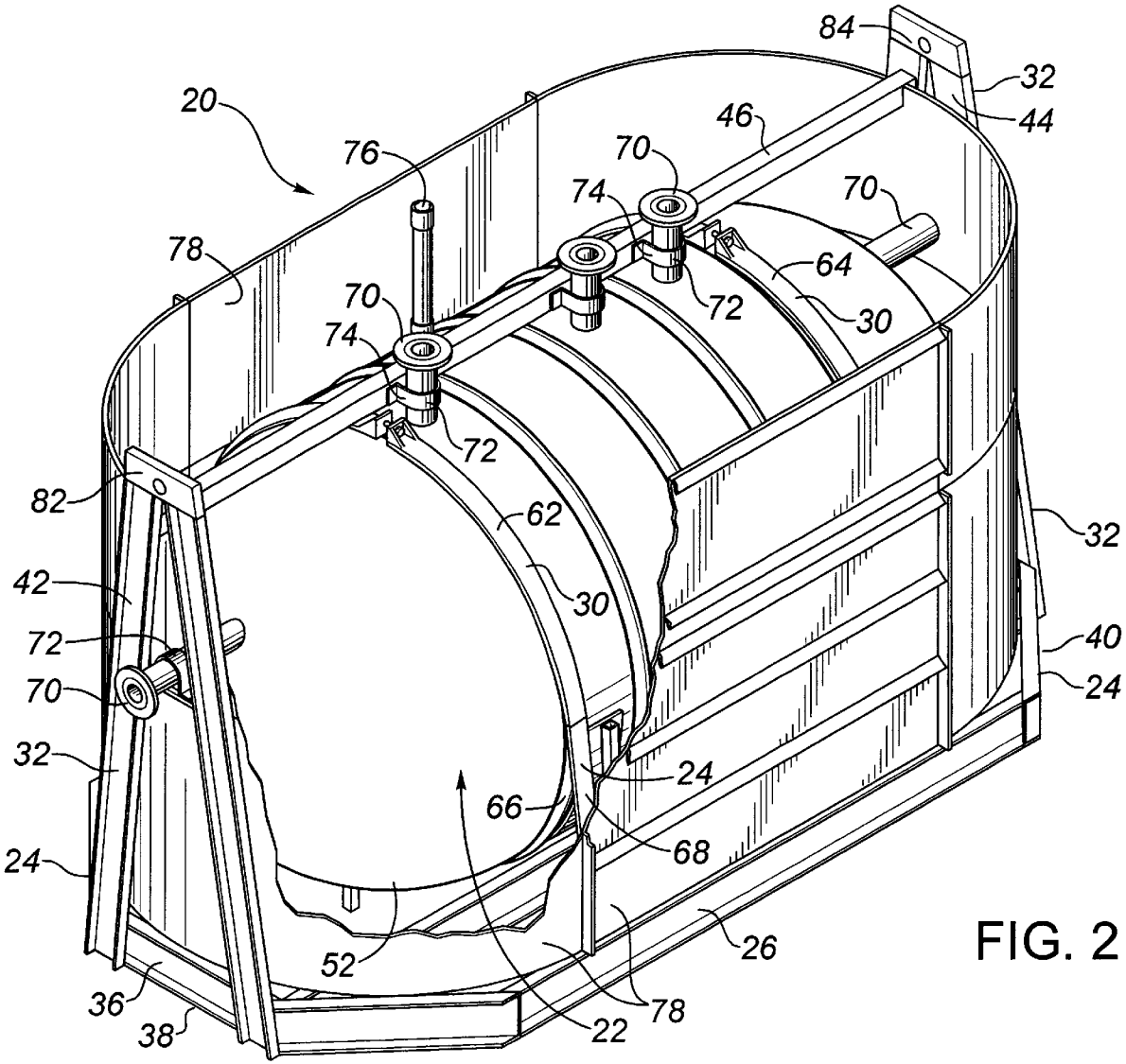
FIG. 2 is a further pictorial view of the preferred embodiment of the submersible storage vessel system as shown in FIG. 1, wherein an exterior shell comprising the support structure has a cut away portion.

Referring to FIG. 1, in a preferred embodiment the invention is a submersible storage vessel system (20). The system (20) comprises a storage vessel (22) and a support structure (24).

The storage vessel (22) may be any shape or size, and may be fabricated of virtually any type of material, including fiberglass, plastic, metal and composite materials. The storage vessel (22) may be of single wall construction or it may provide secondary containment either through double wall construction or through some other secondary containment mechanism. In summary, any submersible storage vessel may be used in the invention as the storage vessel (22), including conventional storage vessels of the type typically used in underground applications. Most preferably, the storage vessel (22) is cylindrical in shape and is installed horizontally.

In the preferred embodiment, the storage vessel (22) is a single wall or double wall fiberglass underground storage vessel having a capacity of between about 25 barrels and about 200 barrels. An example of a preferred storage vessel (22) for use in the invention is a fiberglass storage vessel manufactured by ZCL Composites Inc. of Edmonton, Alberta, Canada and sold under the trade-mark "Greentank".

Conventional storage vessels are prone to damage and failure during their installation because they are largely unprotected during the installation procedure. In addition, the conventional installation procedure for underground storage vessels is complicated, time consuming and expensive. Once installed, conventional underground storage vessels are also prone to damage and failure while in service due to inadequate site preparation, ground settlement, and excessive surface loading.

In the preferred embodiment, the support structure (24) performs a number of functions. First, the support structure (24) protects the storage vessel (22) during transportation, installation and while in service. As a result of this protection, the storage vessel (22) can in some cases be installed more shallow in comparison with conventional installations. Second, the support structure (24) simplifies the installation procedure for the storage vessel (22). Third, the support structure (24) performs an anchoring function which inhibits the storage vessel from upward movement in response to upward buoyancy forces which may be applied to the storage vessel (22). In the preferred embodiment, these functions are achieved by the specific features of the support structure (24).

Figure 7:
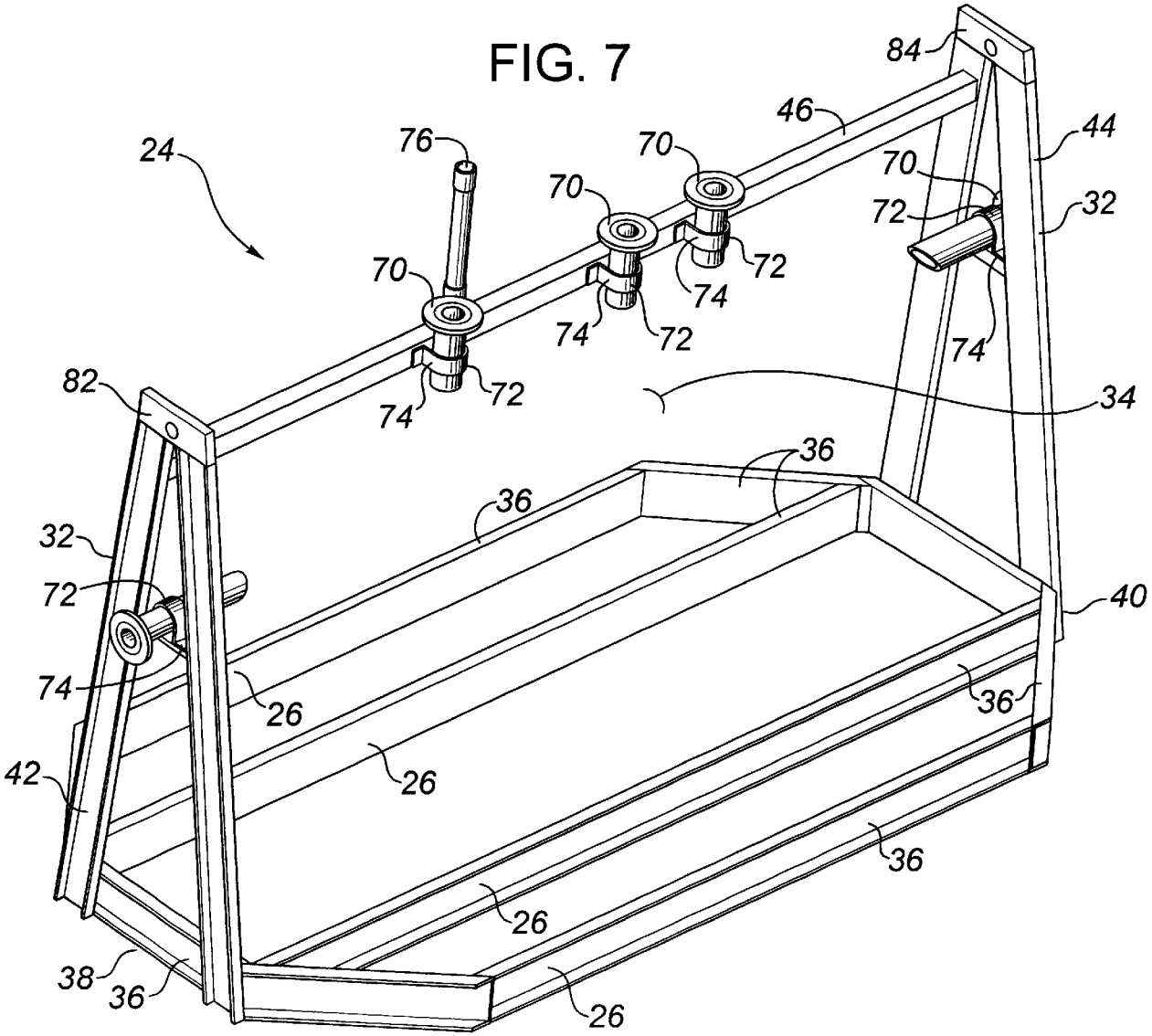
FIG. 7 is a further pictorial view of the preferred embodiment of the submersible storage vessel system as shown in FIG. 6, wherein a vessel support comprising the support structure has been removed therefrom.

Referring to FIG. 7, the support structure (24) includes a bearing surface (26), a vessel support (28) and a vessel anchor (30). The storage vessel (22) is supported on the vessel support (28) and is anchored against upward movement by the vessel anchor (30). The bearing surface (26) provides support for the support structure (24) and thus the entire system (20) on a ground surface on which the system (20) may be placed. In this specification, "ground surface" includes undisturbed soil, backfill, concrete, sand, gravel or any other material upon which the system (20) may be placed.

In the preferred embodiment, the support structure (24) provides a frame (32) which defines a vessel housing (34) for the storage vessel (22). This vessel housing (34) provides protection for the storage vessel (22) during transportation, installation and while in service.

The frame (32) comprises a number of frame elements which are preferably fabricated from steel and are preferably connected together by welding. Each of these frame elements may consist of one frame member or they may be comprised of a number of frame members. The frame elements may also be fabricated of materials other than steel and may be connected with bolts, rivets or any other method instead of by welding.

A bearing frame element (36) provides a foundation for the frame (32) and also provides the bearing surface (26). In the preferred embodiment, the bearing frame element (36) is comprised of a number of steel frame members on a steel plate which are all welded together to form a skid. One end of the bearing frame element (36) defines a first support structure end (38) and the other end of the bearing frame element (36) defines a second support structure end (40).

A first frame element (42) extends vertically upward from the bearing frame element (36) adjacent to the first support structure end (38). In the preferred embodiment, the first frame element (38) is comprised of three steel frame members which are welded together and to the bearing frame element (36). A second frame element (44) extends vertically upward from the bearing frame element (36) adjacent to the second support structure end (40). In the preferred embodiment, the second frame element (42) comprises three steel frame members which are welded together and to the bearing frame element (36).

A third frame element (46) extends horizontally between the first and second frame elements (42,44) adjacent to their upper ends. In the preferred embodiment, the third frame element (46) is a single steel frame member which is welded to the first and second frame elements (42,44).

Figure 3:
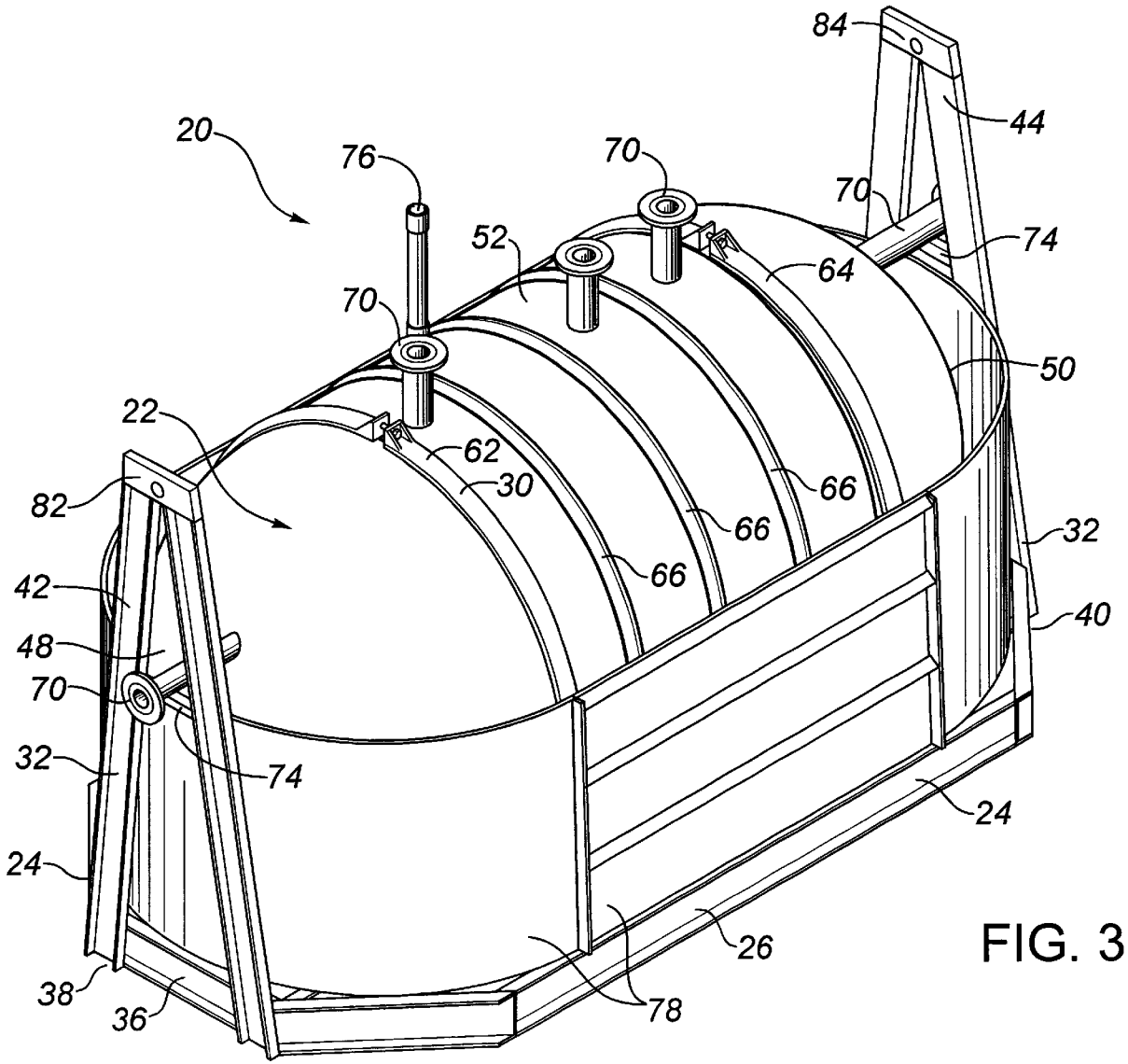
FIG. 3 is a further pictorial view of the preferred embodiment of the submersible storage vessel system as shown in FIG. 1, wherein a portion of the, exterior shell has been removed therefrom.

Referring to FIG. 3, in the preferred embodiment the storage vessel (22) has a vessel length, a first vessel end (48), a second vessel end (50) and an exterior surface (52). The storage vessel (22) is positioned within the frame (32) between the bearing frame element (36), the first frame element (42), the second frame element (44) and the third frame element (46). The first vessel end (48) is adjacent to the first support structure end (38) and the second vessel end (50) is adjacent to the second support structure end (40). By being positioned within the frame (32), the storage vessel (22) can be provided with some protection from damage.

Figure 6:
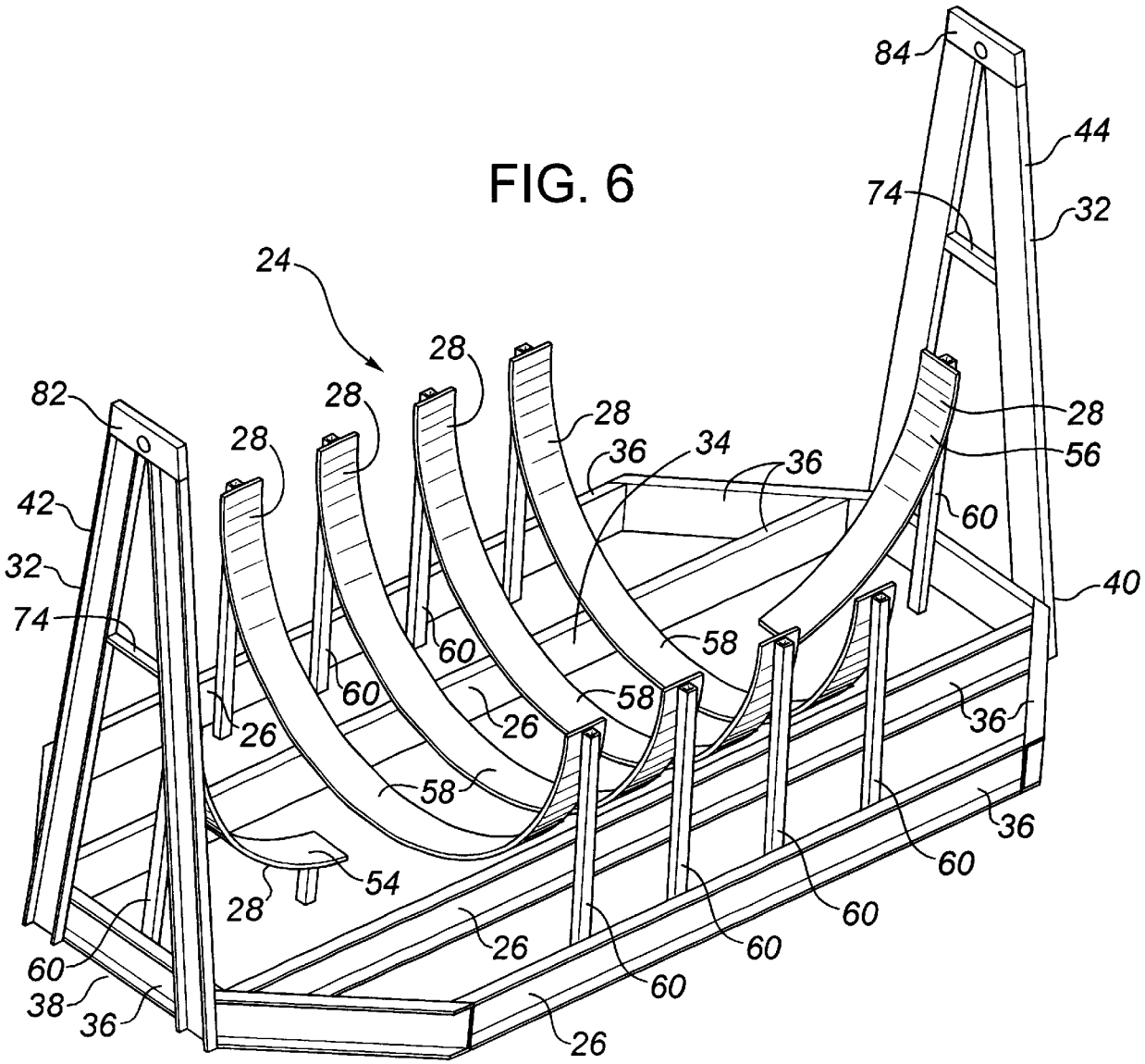
FIG. 6 is a further pictorial view of the preferred embodiment of the submersible storage vessel system as shown in FIG. 5, wherein a vessel anchor comprising the support structure has been removed therefrom.

Referring to FIG. 6, the function of the vessel support (28) is to enable the storage vessel (22) to be supported by the support structure (24) such that any downward gravitational force applied to the storage vessel (22) can be transferred to the support structure.

This downward gravitational force may create bending moments which tend to cause the storage vessel (22) to buckle or sag between its ends (48,50) if the storage vessel (22) is not supported between its ends (48,50). In addition, any support points for the storage vessel (22) create the potential for point loading, which can place high stresses on the storage vessel (22) due to concentration of the downward gravitational force over a small bearing area.

As a result, preferably, the vessel support (28) supports the storage vessel (22) at more than one location in order to minimize the bending moments which are applied to the storage vessel (22). More preferably, the vessel support (28) supports the storage vessel (22) at a plurality of locations evenly along the vessel length so that the bending moments are very small. Most preferably, the vessel support (28) also provides a substantial bearing area over which to support the downward gravitational force so that the effects of point loading are minimized. The objective of the vessel support (28) is therefore to distribute the downward gravitational force over as much of the exterior surface (52) of the storage vessel (22) as is practical.

In the preferred embodiment, the vessel support (28) is comprised of a plurality of vessel support elements. Specifically, in the preferred embodiment the vessel support (28) is comprised of a first longitudinal rib (54) for supporting the storage vessel (22) at the first vessel end (48), a second longitudinal rib (56) for supporting the storage vessel (22) at the second vessel end (50), and a plurality of transverse ribs (58) for supporting the storage vessel (22) between the first and second vessel ends (48,50). The number of transverse ribs (58) will depend upon the vessel length and upon the acceptable bending moments and point loading which are to be applied to the storage vessel (22). For a 50 barrel storage vessel (22), it has been found that four transverse ribs (58) are desirable.

The storage vessel (22) is thus preferably supported substantially evenly between its ends, and bending moments are preferably minimized. Furthermore, in the preferred embodiment the ribs (54,56,58) each provide a substantial bearing area over which to support the downward gravitational force so that the effects of point loading are minimized.

In applications where bending moments experienced by the storage vessel (22) are not a concern, it may not be necessary to support the storage vessel (22) at a plurality of locations along the vessel length, with the result that only one or two vessel support elements may be required. Similarly, in applications where point loading is not a concern, it may not be necessary to provide vessel support elements which have a substantial bearing area, with the result that ribs (54,56,58) may not be required as the vessel support elements.

In the preferred embodiment, the ribs (54,56,58) are each connected to the frame (32) with support struts (60) which are in turn connected to the bearing frame element (36). The ribs (54,56,58) may, however be incorporated into the support structure (24) in any manner. For example, the ribs (54,56,58) may be directly connected to the frame (32) without the use of the support struts (60).

Figure 5:
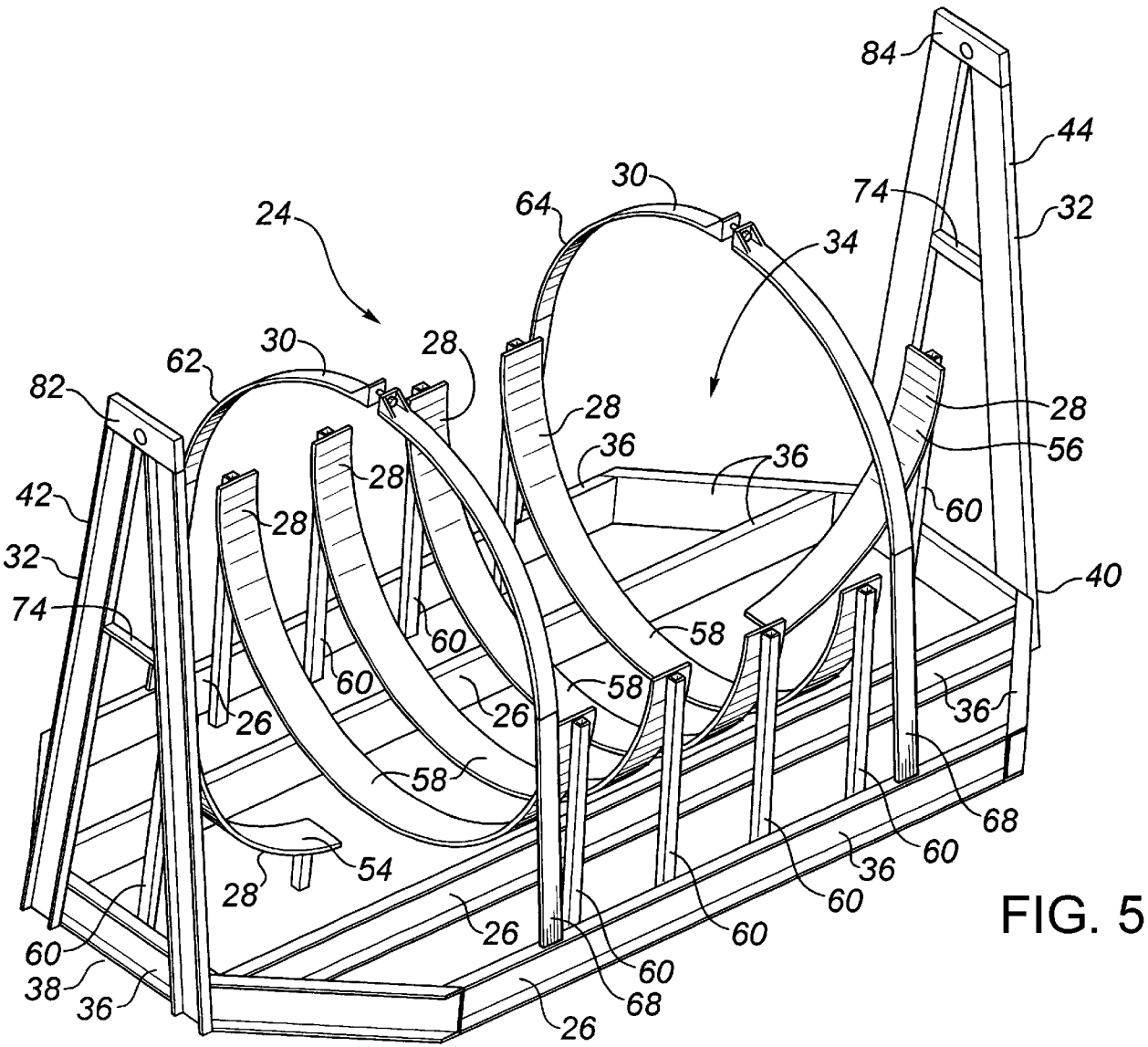
FIG. 5 is a further pictorial view of the preferred embodiment of the submersible storage vessel system as shown in FIG. 4, wherein the storage vessel has been removed therefrom.

Referring to FIG. 5, the function of the vessel anchor (30) is to anchor the storage vessel to the support structure (24) such that any upward buoyancy force applied to the storage vessel (22) can be transferred to the support structure (24).

It may be expected that the net upward buoyancy force that may be experienced by the storage vessel (22) will typically be less than the downward gravitational force that may be experienced by the storage vessel (22), since the weight of the submerging medium above the storage vessel (22) may offset some of the upward buoyancy force. As a result, it may not be as important to evenly distribute the upward buoyancy force as it is to evenly distribute the downward gravitational force, since any bending moments and point loading produced by the upward buoyancy force may be unlikely to cause damage to the storage vessel (22).

The vessel anchor (30) may be comprised of a holddown strap which extends around the storage vessel (22) and is connected to the support structure (24). The vessel anchor (30) may also be comprised of any other holddown device which can connect the storage vessel (22) with the support structure (24) such that the upward buoyancy force applied to the storage vessel (22) can be transferred to the support structure (24). For example, the storage vessel (22) may be bolted, welded or screwed to the vessel anchor (30), or the vessel anchor (30) may be comprised of a member or member which engages the storage vessel (22) to perform the anchoring function without being fixed to the storage vessel (22). The vessel support (28) may also function as the vessel anchor (30) if the vessel support (28) can also perform the anchoring function.

Preferably the vessel anchor (30) is comprised of at least one holddown device. In the preferred embodiment, the vessel anchor (30) is comprised of two holddown devices which anchor the storage vessel (22) to the support structure (24) between the first vessel end (48) and the second vessel end (50). In the preferred embodiment, the holddown devices are comprised of holddown straps. A first holddown strap (62) is located adjacent to the first vessel end (48) and a second holddown strap (64) is located adjacent to the second vessel end (50).

Each of the holddown straps (62,64) extends around the storage vessel (22) and preferably fits in a groove (66) formed in the exterior surface (52) of the storage vessel (22). In the preferred embodiment, the holddown straps (62,64) are adjustable fiberglass straps which are each capable of providing an anchoring force of about 20,000 pounds. The ends of the holddown straps (62,64) are connected to the frame (32) with anchor struts (68) which in turn are connected to the bearing frame element (36). The holddown straps (62,64) may, however be incorporated into the support structure (24) in any manner. For example, the holddown straps (62,64) may be directly connected to the frame (32) without the use of the anchor struts (68).

Figure 4:
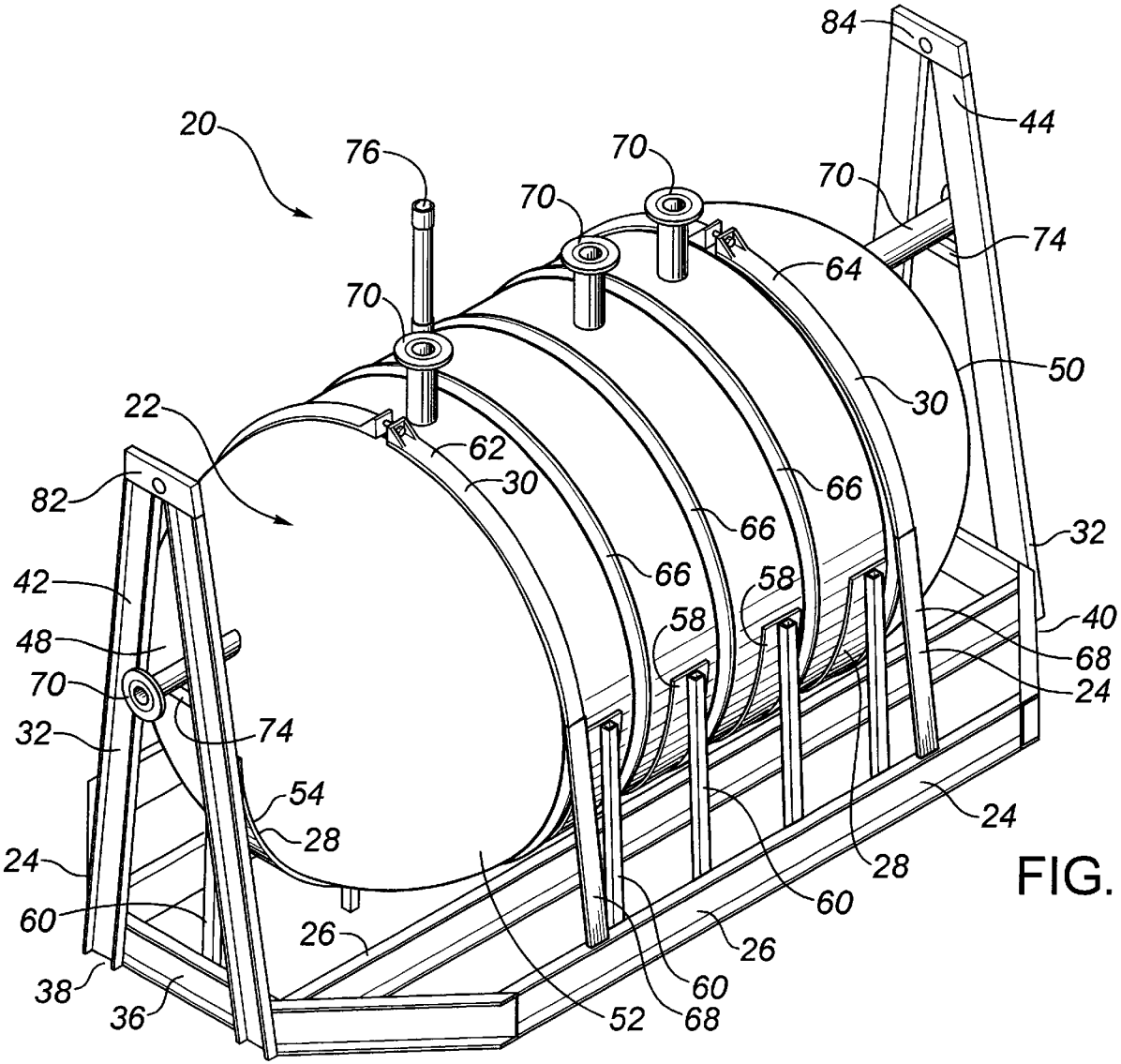
FIG. 4 is a further pictorial view of the preferred embodiment of the submersible storage vessel system as shown in FIG. 3, wherein the external shell has been completely removed therefrom.

Referring to FIG. 4, the storage vessel (22) may be equipped with one or more fittings (70). These fittings (70) facilitate access to an interior chamber defined by the storage vessel (22) and may be used for an inlet, an outlet, gauge access, leak detection, pressure relief, as a drop tube, still well, standpipe or for any other purpose. These fittings (70) may be located at the ends (48,50) of the storage vessel (22) or they may be located between the ends (48,50) of the storage vessel (22).

In conventional installations, the storage vessel (22) is vulnerable to damage at the location of the fittings (70). The reason for this is that any movement of the storage vessel (22) relative to the fittings (70) will create stresses in the storage vessel (22) at the location of the fittings (70). These stresses may either damage the storage vessel (22) or cause it to fail altogether.

Referring to FIG. 7, in the preferred embodiment the present invention isolates the storage vessel (22) from these stresses by providing fitting anchors (72) for connecting all or some of the fittings (70) to the support structure (24). Each fitting anchor (72) transfers the fitting force associated with a particular fitting (70) to the support structure (24) so that the fitting force creates stresses in the support structure (24) and not in the storage vessel (22).

In the preferred embodiment, each fitting anchor (72) is comprised of a bracket (74) which connects a fitting (70) to the frame (32). The fitting anchors (72) may, however, be comprised of any device which can transfer the fitting force to the support structure (24). For example, the fitting anchors (72) may be straps, flanges, or welds.

In the preferred embodiment, the storage vessel (22) is equipped with a fitting (70) at the first vessel end (48) which is connected with the support structure (24) with a bracket (74) which in turn is connected to the first frame element (42). The storage vessel (22) is also equipped with a fitting (70) at the second vessel end (50) which is connected with the support structure (24) with a bracket (74) which in turn is connected to the second frame element (44). Finally, the storage vessel (22) is equipped with a plurality of fittings (70) between the ends (48,50) of the storage vessel (22) which in turn are connected to the third frame element (46).

It may not be necessary to provide fitting anchors (70) if the fitting (70) is not intended to be rigidly connected with other piping, since the fitting (70) in such circumstances will tend to move freely with the storage vessel (22) and dangerous stresses may not develop. In the preferred embodiment, one of the fittings (72) is a standpipe (76) for which a fitting anchor (72) is optional.

The fittings (70) may be of any length. In the preferred embodiment, the system (20) is assembled with relatively short fittings (70) and risers are added as needed during installation of the system (20) so that the fittings (70) can be accessed following installation.

Referring to FIGS. 1–4 and 7 and as previously described, in the preferred embodiment the frame (32) defines a vessel housing (34) for the storage vessel (22) which provides protection for the storage vessel (22) during transportation, installation and while in service. In the preferred embodiment, the support structure (24) is further comprised of an exterior shell (78) which substantially surrounds the vessel housing (34).

The exterior shell (78) may be constructed to provide a secondary containment function in the event of a leak in the storage vessel (22). In the preferred embodiment, however, the primary function of the exterior shell (78) is not to provide secondary containment but rather to contain a packing material (79) which substantially surrounds the storage vessel (22) within the vessel housing (34). In the preferred embodiment, the exterior shell (78) is fabricated from sheet metal but any material may be used which will provide the desired containment function without significant deterioration following installation of the system (20).

Figure 8:
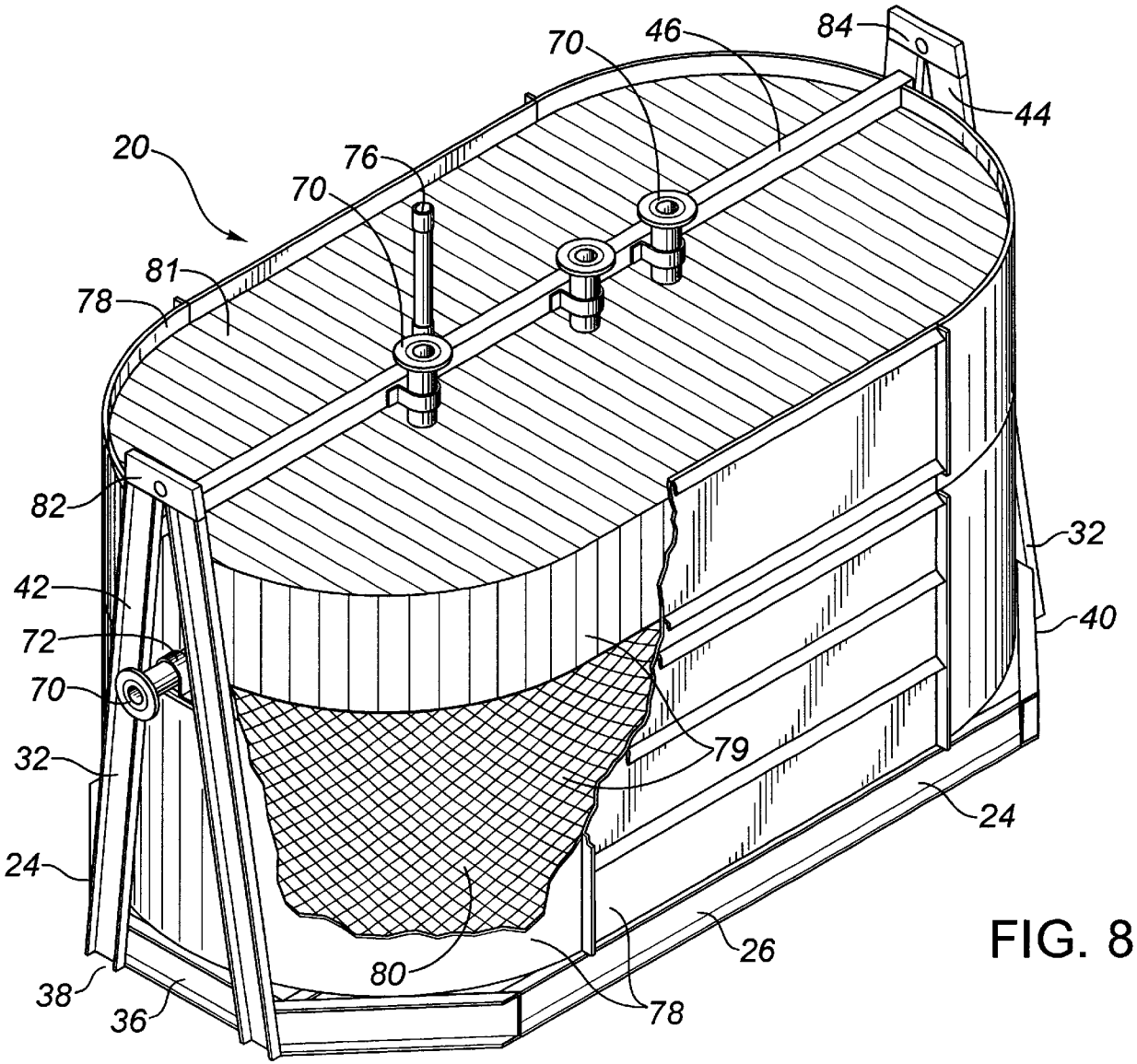
FIG. 8 is a further pictorial view of the preferred embodiment of the submersible storage vessel system as shown in FIG. 1, wherein a packing material is depicted.

Referring to FIG. 8, the packing material (79) provides two functions for the system (20). First, the packing material (79) provides additional protection and support for the storage vessel (22). Second, the packing material (79) adds weight to the system (20).

In the preferred embodiment, the system (20) has a weight sufficient to overcome the upward buoyancy force when the system (20) is submerged and the storage vessel (22) is empty. If such sufficient weight is provided, the system (20) will not require any secondary form of anchoring device.

If the system (20) does not have sufficient weight to overcome the upward buoyancy force, the storage vessel (22) will still be protected by the support structure (24) and the storage vessel (22) will still be supported by the support structure (24) against the effects of the downward gravitational force and the upward buoyancy force, but the entire system may tend to move upward when the upward buoyancy force is applied to the storage vessel (22). In such circumstances, some form of secondary anchoring device may be required for the entire system (20).

In the preferred embodiment, the system (20) is provided with sufficient weight to overcome the upward buoyancy force primarily from the weight of the frame (32) and the weight of the packing material (79).

The packing material (79) is preferably comprised of a particulate material which can be placed in the vessel housing (34) and will surround the storage vessel (22). The packing material (79) may, however, be comprised of any material, including solids, liquids, gels and foams which can perform one or both of the intended functions of the packing material (79).

In the preferred embodiment and referring to FIG. 8, the packing material (79) is comprised of aggregate such as gravel or sand and is also comprised of rubber particles. The rubber particles may be obtained from discarded rubber products such as tires. The spaces in the vessel housing (34) surrounding the storage vessel (22) are first filled with a layer of rubber particles (80) and are topped off with a layer of aggregate (81) so that the storage vessel (22) is substantially surrounded by the packing material (79). Preferably the layer of rubber particles (80) extends to the top of the storage vessel (22) and the layer of aggregate (81) extends to the bottom of the third frame element (46). Either aggregate or rubber particles may also be used on their own as the packing material (79).

In the preferred embodiment the system (20) is intended to protect the storage vessel (22) during installation in and removal from a submerged environment. One aspect of this protection is that the system (20) is preferably lifted by the support structure (24) and not by the storage vessel (22) so that the lifting force 30 is not applied directly to the storage vessel (22). As a result, preferably the support structure (24) is equipped with at least one lifting lug which can be connected to a lifting device (not shown) to lift and move the system (20). In this specification, a "lifting lug" is any surface associated with the support structure (24) to which the lifting device (not shown) can be connected to lift the system (20). For example, hooks, apertures or loops or other structures could be associated with any of the frame elements (36, 42,44,46) in order to function as lifting lugs.

Alternatively, the system (20) may be moved using other devices and techniques. For example, straps (not shown) may be placed underneath the bearing frame element (36) and then the straps (not shown) could be connected to the lifting device (not shown).

Referring to FIG. 1, in the preferred embodiment the support structure (24) is comprised of two lifting lugs. A first lifting lug (82) is associated with the first frame element (42) and a second lifting lug (84) is associated with the second frame element (44). In the preferred embodiment, each lifting lug (82,84) is comprised of an aperture in its respective frame element (42,44) to which the lifting device (not shown) can be connected.

The system (20) is preferably fabricated and assembled offsite and is then transported and installed as an integral unit. This enables the fabrication to be conducted in a more controlled environment such as a shop floor and potentially offers a superior storage vessel installation in comparison with conventional submersible installations where the system (20) is not utilized and the storage vessel (22) is installed without the support structure (24). Preferably the metal components of the system (20) are rustproofed during fabrication and assembly and the system (20) is pressure tested and otherwise inspected before leaving the fabrication facility.

If the weight of the complete system (20) is too great for the available lifting device (not shown), all or some of the packing material (79) may be packed in the vessel housing (34) after the system (20) has arrived at its final destination.

The preferred installation procedure for the system (20) involves a number of simple steps, some of which can be performed before the system (20) arrives at the installation site and others which require the system (20) to be onsite.

First, a hole is excavated with dimensions approximately one foot larger than the plan view dimensions of the storage vessel (22). The hole is excavated to a depth specified by applicable codes or by the manufacturer's instructions for the particular storage vessel (22).

As previously indicated, the use of the support structure (24) as in the preferred embodiment may enable the storage vessel (22) to be installed more shallow in comparison with conventional installations due to the support and protection provided by the support structure (24). The use of the support structure (24) as in the preferred embodiment may not, however, typically enable the storage vessel (22) to be installed deeper in comparison with conventional installations, since in the preferred embodiment the support structure (24) does not completely isolate the storage vessel (22) from the forces exerted on the storage vessel (22) by the submerging medium.

Second, the bottom of the hole is leveled and compacted if desired.

Third, the system (20) is lifted by the lifting lugs (82,84) and then lowered into the hole.

Fourth, the system (20) is raised and lowered several times to ensure that the bottom of the hole is compacted sufficiently to support the system (20). If necessary, packing material (79) may be added to the vessel housing (34) if it is not already in the vessel housing (34).

Fifth, any necessary risers are installed on the fittings (70).

Sixth, the gap between the walls of the hole and the system (20) are filled with a suitable backfill material such as gravel or sand.

Seventh, the portion of the hole above the system (20) is filled with a suitable backfill material such as material removed during excavation of the hole.

Eighth, any piping which must be connected to the risers is connected and any associated instruments and equipment are also installed and connected to the system as necessary.

Last, any desired surface protection device for the system (20) is installed. If the desired surface protection device is a truck guard, piles are installed and any associated gate sections are connected to the piles.

The potential installation advantages of the system (20) over conventional submersible storage vessel installations are many and include the following. First, damage during transportation and installation is unlikely. Second, the system (20) may be installed without workers in the hole during the installation procedure, thus resulting in a safer installation procedure. Third, the size of the hole may be reduced since a separate anchoring device is not normally required. Fourth, the requirements for backfill onsite will be lower than with conventional installations. Fifth, the system (20) may be installed under virtually any weather and soil conditions, including wet soil conditions without the buoyancy and shoring concerns associated with conventional installations. Sixth, the installation time can be greatly reduced in comparison with conventional installations, since site preparation requirements can be significantly minimized. Seventh, the system (20) may be reused after it has been removed from the hole, making repairs to the system (20) or to the storage vessel (22) in particular more feasible.

The embodiments of the invention in which an exclusive property or privilege is claimed are defined as follows:

1. A prefabricated and preassembled storage vessel system for subterranean installation in ground having a groundwater table, the system comprising:

(a) a storage vessel having a weight;

(b) a support structure connected with the storage vessel, wherein the support structure defines a vessel housing, wherein the storage vessel is contained within the vessel housing, and wherein the support structure is comprised of:

(i) a bearing surface adapted for contacting the ground such that the system is supported on the ground;

(ii) a vessel support for supporting the storage vessel such that the weight of the storage vessel is transferred to the support structure;

(iii) a vessel anchor for anchoring the storage vessel against an upward buoyancy force exerted on the storage vessel when the groundwater table at least partly submerges the storage vessel, such that the upward buoyancy force is transferred to the support structure;

(iv) an exterior shell substantially surrounding the vessel housing, wherein the exterior shell permits the groundwater table to infiltrate the vessel housing such that the upward buoyancy force is exerted on the storage vessel; and (c) a packing material contained within the vessel housing by the exterior shell, the packing material substantially surrounding the storage vessel in order to protect the storage vessel.

2. The system as claimed in claim 1 wherein the storage vessel is comprised of an exterior surface and wherein the vessel support contacts the exterior surface of the storage vessel at more than one location on the exterior surface of the storage vessel.

3. The system as claimed in claim 2 wherein the vessel support is comprised of a plurality of vessel support elements which contact the exterior surface of the storage vessel at a plurality of locations on the exterior surface of the storage vessel.

4. The system as claimed in claim 3 wherein the storage vessel has a vessel length, a first vessel end and a second vessel end and wherein the vessel support elements support the storage vessel between the first vessel end and the second vessel end.

5. The system as claimed in claim 3 wherein the storage vessel has a vessel length, a first vessel end and a second vessel end and wherein the vessel support elements are comprised of a plurality of transverse ribs which are spaced between the first vessel end and the second vessel end to support the storage vessel between the first vessel end and the second vessel end.

6. The system as claimed in claim 5 wherein the vessel support elements are further comprised of a first longitudinal rib for supporting the storage vessel at the first vessel end and a second longitudinal rib for supporting the storage vessel at the second vessel end.

7. The system as claimed in claim 1 wherein the vessel anchor is comprised of at least one holddown device associated with the support structure for anchoring the storage vessel to the support structure.

8. The system as claimed in claim 7 wherein the holddown device is comprised of at least one holddown strap.

9. The system as claimed in claim 8 wherein the storage vessel has a first vessel end and a second vessel end and wherein the vessel anchor is comprised of a first holddown strap and a second holddown strap which connect the storage vessel with the support structure between the first vessel end and the second vessel end.

10. The system as claimed in claim 1 wherein the storage vessel defines an interior chamber, wherein the storage vessel is further comprised of at least one fitting to facilitate access to the interior chamber, and wherein the support structure further comprises a fitting anchor for connecting the fitting with the support structure so that a fitting force applied to the fitting is transferred to the support structure.

11. The system as claimed in claim 1 wherein the packing material is comprised of aggregate.

12. The system as claimed in claim 1 wherein the packing material is comprised of rubber particles.

13. The system as claimed in claim 12 wherein the packing material is further comprised of aggregate.

14. The system as claimed in claim 1 wherein the support structure is further comprised of at least one lifting lug for lifting the system without applying a lifting force directly to the storage vessel.

15. The system as claimed in claim 1 wherein the support structure has a first support structure end and a second support structure end, wherein the support structure is comprised of a first lifting lug located adjacent to the first support structure end and a second lifting lug located adjacent to the second support structure end, and wherein the first lifting lug and the second lifting lug enable the system to be lifted without applying the lifting force directly to the storage vessel.

16. The system as claimed in claim 15 wherein the support structure is further comprised of a first frame element located adjacent to the first support structure end and a second frame element located adjacent to the second support structure end, wherein the first lifting lug is associated with the first frame element, and wherein the second lifting lug is associated with the second frame element.

17. The system as claimed in claim 16 wherein the storage vessel defines an interior chamber, wherein the storage vessel is further comprised of at least one fitting to facilitate access to the interior chamber, and wherein the support structure further comprises a fitting anchor for connecting the fitting with the support structure so that a fitting force applied to the fitting is transferred to the support structure.

18. The system as claimed in claim 17 wherein the fitting anchor connects the fitting to the first frame element or to the second frame element.

19. The system as claimed in claim 18 wherein the support structure is further comprised of a third frame element which is connected to at least one of the first frame element and the second frame element, and wherein the fitting anchor connects the fitting to the first frame element, to the second frame element, or to the third frame element.

20. The system as claimed in claim 19 wherein the packing material is comprised of aggregate.

21. The system as claimed in claim 20 wherein the storage vessel is constructed of a corrosion resistant material.

22. The system as claimed in claim 21 wherein the corrosion resistant mate raised of fiberglass.

23. The system as claimed in claim 20 wherein the exterior shell is comprised of sheet metal.

24. The system as claimed in claim 19 wherein the packing material is comprised of rubber particles.

25. The system as claimed in claim 24 wherein the packing material is further comprised of aggregate.

26. The system as claimed in claim 1 wherein the system has a weight sufficient to overcome the upward buoyancy force when the storage vessel is empty and is completely submerged by the groundwater table.

* * * * *

UNITED STATES PATENT AND TRADEMARK OFFICE

CERTIFICATE OF CORRECTION

PATENT NO. : 6,254,309 B1
DATED : July 3, 2001
INVENTOR(S) : Robert William Northcott and Grant M. Askin It is certified that error appears in the above-identified patent and that said Letters Patent is hereby corrected as shown below:

Column 14,
Line 11, after "force" delete -- 30 --.

Column 18,
Line 15, change "mate raised" to -- material is comprised --.

Signed and Sealed this

Thirtieth Day of April, 2002

*Attest:*

*Attesting Officer*

JAMES E. ROGAN
*Director of the United States Patent and Trademark Office*